US006340235B1

(12) United States Patent
Bryan

(10) Patent No.: US 6,340,235 B1
(45) Date of Patent: Jan. 22, 2002

(54) ADAPTABLE ELECTRIC ACCESSORY SYSTEM FOR CONTAINERS, RECEPTACLES, AND THE LIKE

(76) Inventor: Jimmy H. Bryan, 1031 Voight, Houston, TX (US) 77009

( * ) Notice: Subject to any disclaimer, the term of this patent is extended or adjusted under 35 U.S.C. 154(b) by 0 days.

(21) Appl. No.: 09/460,368

(22) Filed: Dec. 13, 1999

Related U.S. Application Data

(63) Continuation-in-part of application No. 09/005,655, filed on Jan. 12, 1998.

(51) Int. Cl.[7] ..... A45C 15/06

(52) U.S. Cl. ..... 362/156; 362/154; 362/155; 362/570; 362/577; 150/101; 150/102; 150/103

(58) Field of Search ..... 362/154, 155, 362/156, 570, 577; 150/101, 102, 103

(56) References Cited

U.S. PATENT DOCUMENTS 3,808,416 A * 4/1974 Pottratz ..... 240/6.45 P
4,234,907 A * 11/1980 Daniel ..... 362/103
4,885,570 A * 12/1989 Chien ..... 340/571
5,067,063 A * 11/1991 Granneman et al. ..... 362/156
5,424,926 A * 6/1995 Myers ..... 362/156
5,444,605 A * 8/1995 Rivera ..... 362/156
5,610,979 A * 3/1997 Yu ..... 379/455
5,768,163 A * 6/1998 Smith, II ..... 364/705.01
5,908,232 A * 6/1999 Burns et al. ..... 362/156
5,955,797 A * 9/1999 Kim ..... 307/150
6,120,162 A * 9/2000 Guerrieri ..... 362/155

* cited by examiner

*Primary Examiner*—Sandra O'Shea
*Assistant Examiner*—Guiyoung Lee

(57) ABSTRACT

An adaptable electric accessory system comprising a receptacle having an interior compartment, an illumination apparatus, and a power source for supplying power to the apparatus. The system may be provided with an insert removably positioned in the interior compartment of the receptacle. The illumination apparatus may be mounted on the insert or container for illuminating the insert. A charging apparatus may be provided for providing power to the power source for recharging the power source and removable electric devices. The receptacle may include a flexible strap with a pair of forcible release assemblies each being connected between one of the ends of the strap and the receptacle for detecting a forcible removal of the receptacle from the person of the user. A timer mechanism may be provided for causing illumination of the illumination apparatus for a predetermined period of time upon the closing of an activating switch. The illumination apparatus may comprise at least one illuminating liner panel positioned on an interior surface of the insert or container or both. An alarm apparatus may provide an alarm upon triggering by the removal of a strap attached to the receptacle or the actuation of an alarm activating switch. A pocket may be provided for removably receiving an electric device, and a power adapting apparatus may be provided for supplying power to an electrical device, with the power adapting apparatus being connected to the power source and base charging system.

37 Claims, 15 Drawing Sheets

ADAPTABLE ELECTRIC ACCESSORY SYSTEM FOR CONTAINERS, RECEPTACLES, AND THE LIKE

CROSS REFERENCE TO RELATED APPLICATION

The present application is a continuation-in-part of an application filed Jan. 12, 1998, and assigned the application Ser. No. 09/005,655, which is incorporated herein by reference.

BACKGROUND OF THE INVENTION

1. Field of the Invention

The present invention relates to a new adaptable electric accessory system for containers, receptacles, and the like for illuminating a receptacle and powering electronic devices situated in the receptacle.

2. Description of the Prior Art

The use of illuminated containers is known in the prior art. More specifically, illuminated containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,912,611; U.S. Pat. No. 4,972,304; U.S. Pat. Des. 315,830; U.S. Pat. No. 4,263,951; U.S. Pat. No. 5,207,254; and U.S. Pat. No. 3,976,871 which are all incorporated herein by reference.

In these respects, the adaptable electric accessory system for containers, receptacles, and the like according to the present invention substantially departs from the conventional concepts and designs of the prior art, and in so doing provides an apparatus primarily developed for the purpose of illuminating a receptacle and powering electronic devices situated therein with a rechargeable onboard battery or batteries as well as recharge the batteries of removable electric devices.

SUMMARY OF THE INVENTION

In view of the foregoing disadvantages inherent in the known types of illuminated containers now present in the prior art, the present invention provides a new adaptable electric accessory system for containers, receptacles, and the like wherein the same can be utilized for illuminating a receptacle and powering electronic devices situated therein with a rechargeable onboard battery or batteries as well as recharge the batteries of removable electric devices.

The general purpose of the present invention, which will be described subsequently in greater detail, is to provide a new adaptable electric accessory system for containers, receptacles, and the like which has many of the advantages of the illuminated containers mentioned heretofore and many novel features that result in a new adaptable electric accessory system for containers, receptacles, and the like which is not anticipated, rendered obvious, suggested, or even implied by any of the prior art illuminated containers, either alone or in any combination thereof.

To attain this, the present invention generally comprises an adaptable electric accessory system including a receptacle having an interior compartment, an illumination apparatus, and a power source for supplying power to the apparatus. The system may be provided with an insert removably positionable in the interior compartment of the receptacle. The illumination apparatus may be mounted on the insert or receptacle for illuminating the insert or receptacle. A charging apparatus may be provided for providing power to the power source for recharging the power source and removable electric devices. The receptacle may include a flexible strap with a pair of forcible release assemblies each being connected between one of the ends of the strap and the receptacle for detecting a forcible removal of the receptacle from the person of the user. A timer mechanism may be provided for causing illumination of the illumination apparatus for a predetermined period of time upon the closing of an activating switch. The illumination apparatus may comprise at least one illuminating liner panel positioned on an interior surface of the insert and/or the receptacle. An alarm apparatus may be included for providing an audible alarm upon triggering of the alarm apparatus, and an alarm activating switch. The alarm apparatus is triggered upon the removal of a strap attached to the receptacle or the actuation of the alarm activating switch. A pocket may be provided for removably receiving an electrical device, and a power adapting apparatus may be provided for supplying power to an electric device, with the power adapting apparatus being connected to the power source and base charging system.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new adaptable electric accessory system for containers, receptacles, and the like which has many of the advantages of the illuminated containers mentioned heretofore and many novel features that result in a new adaptable electric accessory system for containers, receptacles, and the like which is not anticipated, rendered obvious, suggested, or even implied by any of the prior art illuminated containers, either alone or in any combination thereof.

It is another object of the present invention to provide a new adaptable electric accessory system for containers, receptacles, and the like which may be easily and efficiently manufactured and marketed.

It is a further object of the present invention to provide a new adaptable electric accessory system for containers, receptacles, and the like which is of a durable and reliable construction.

An even further object of the present invention is to provide a new adaptable electric accessory system for containers, receptacles, and the like which is susceptible of a low cost of manufacture with regard to both materials and labor, and which accordingly is then susceptible of low prices of sale to the consuming public, thereby making such adaptable electric accessory system for containers, receptacles, and the like economically available to the buying public.

Still yet another object of the present invention is to provide a new adaptable electric accessory system for containers, receptacles, and the like which provides in the apparatuses and methods of the prior art some of the advantages thereof, while simultaneously overcoming some of the disadvantages normally associated therewith.

Still another object of the present invention is to provide a new adaptable electric accessory system for containers, receptacles, and the like for illuminating a receptacle and powering electronic devices situated therein via a rechargeable onboard battery.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
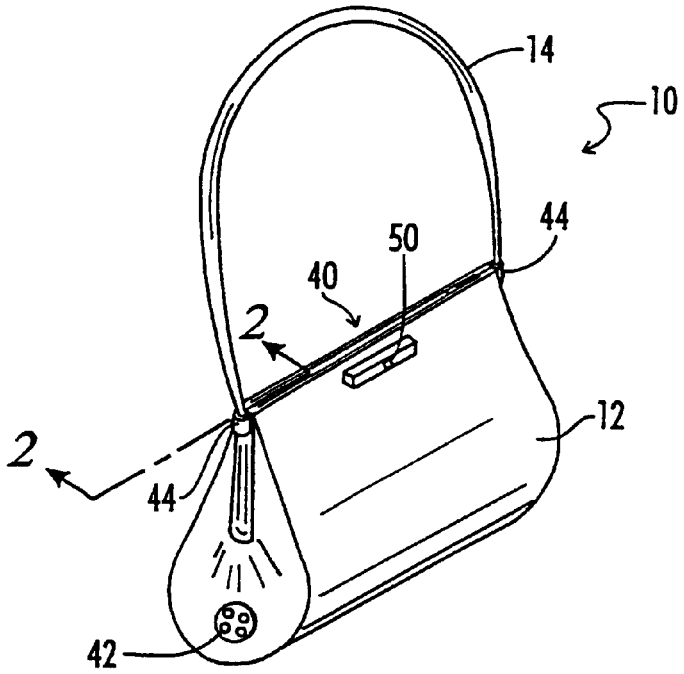
FIG. 1 is a schematic upper perspective view of a new adaptable electric accessory system according to the present invention.

With reference now to the drawings, and in particular to FIGS. 1 through 29 thereof, a new adaptable electric accessory system for containers, receptacles, and the like embodying the principles and concepts of the present invention and generally designated by the reference numeral 10 will be described.

With particular reference to FIGS. 1 through 8, it will be noted that the invention 10 comprises a retainer device 12 adapted to receive a removable liner 20 which is removably positionable within an interior compartment of the retainer device 12 for permitting transfer of the liner 20 between a variety of retainer devices (having, for example, different fashion styles). An illustrative and preferred retainer device is a handbag or purse having a shoulder strap 14 for positioning on the shoulder of a user to support the handbag in a location adjacent to the body of the user. An illustrative handbag is elongated in one direction to form a somewhat pocket-like enclosure with an elongate opening 18. The shape of the handbag may vary due to the flexible nature of the preferred material forming the handbag, and therefore a multitude of shapes may be useful.

A securing means for releasably holding the liner 20 in the interior of the retainer device 12 is preferably provided, and one illustrative means for holding the liner 20 in a position within the handbag retainer device 12 is a zipper having one set 16 of cooperating zipper teeth mounted on the exterior of the liner and the other set 17 of cooperative zipper teeth on the interior of the retainer device.

Figure 3:
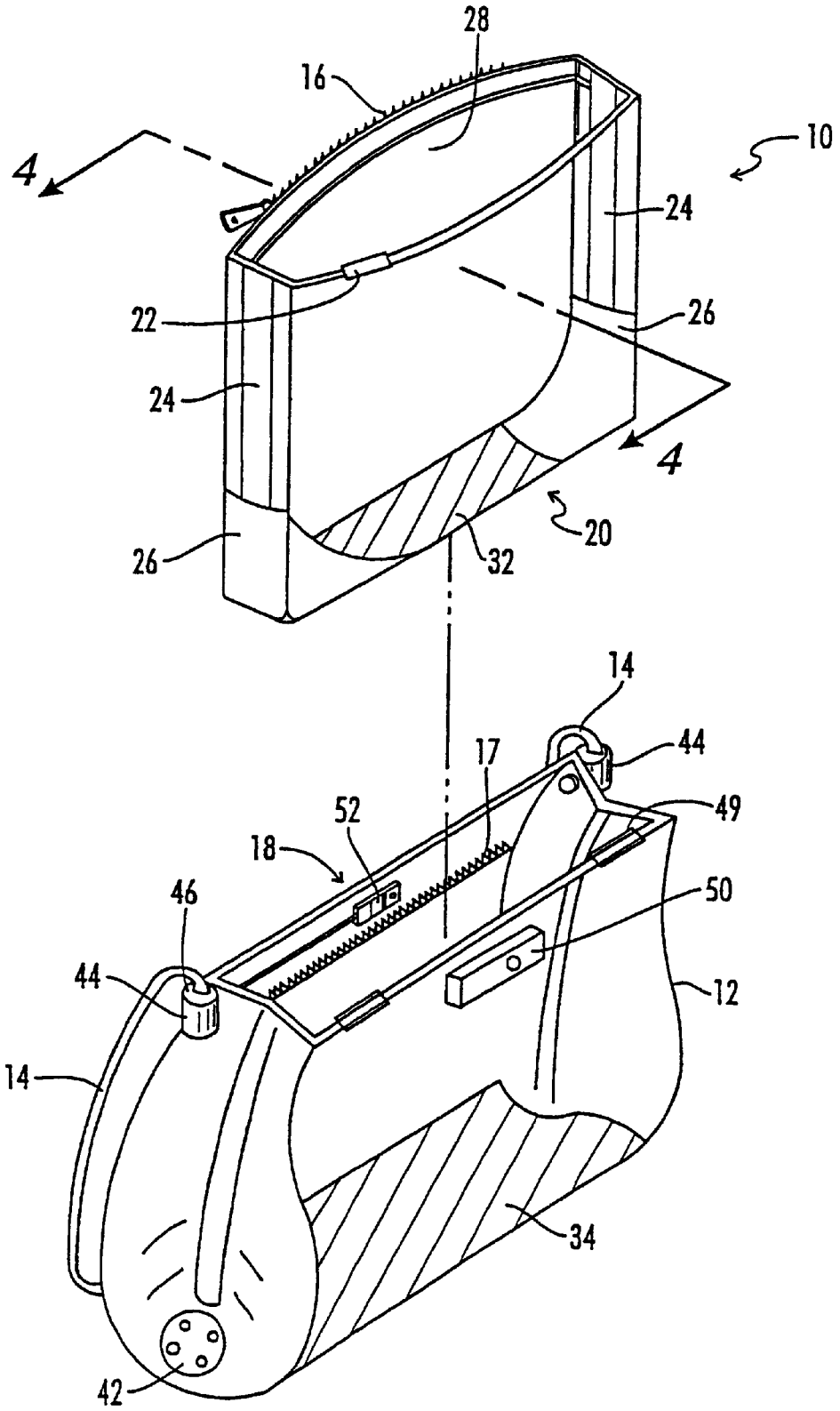
FIG. 3 is a schematic exploded upper perspective view of the present invention.
Figure 4:
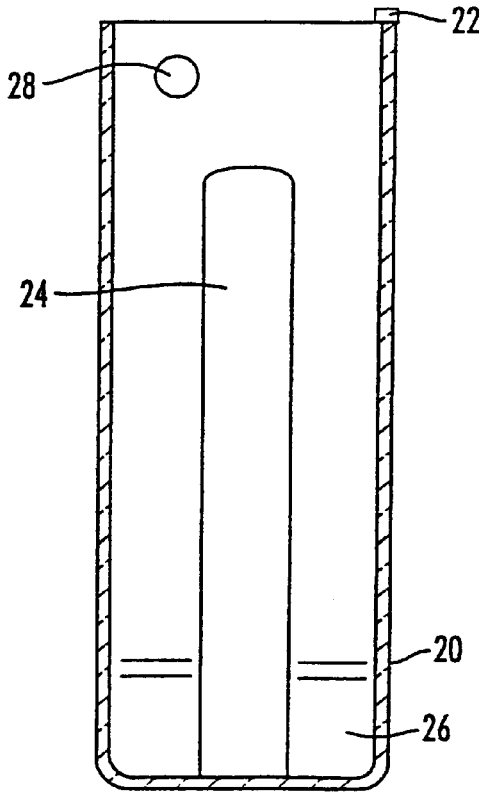
FIG. 4 is a schematic sectional view taken along line 4—4 of FIG. 3.

At least one light source 26 is secured on the liner 20 for illuminating objects held within the liner 20 (as shown in FIGS. 3 and 4). The liner 20 is most preferably constructed from a light emitting fabric 28 which distributes light from the light source to substantially all parts of the liner 20. The light emitting fabric 28 is comprised of a plurality of fiber optic cables or fibers or filaments woven together and optically connected to the light source 26 for emitting light uniformly throughout the liner 20.

The preferred light source 26 for illuminating the fiber optic filaments forming the liner 20 is a laser-based light source 26 and a light reflection/conduction tube 24. Most preferably, a laser light source 26 and a light reflection/conduction tube 24 are located at each longitudinal end of the handbag retainer device 12. The laser light source 26 is preferably located at a lower corner location in the interior of the liner 20, and the light reflection/conduction tube 24 extends upwardly from the laser light source 26 along the longitudinal end of the liner compartment. The laser light source 26 is in optical communication with the reflection/conduction tube 24, and in turn the reflection/conduction tube is in optical communication with the ends of the woven fiber optic filaments of the material forming the liner 20.

The light source 26 is preferably electrically connected to a power source 32 carried on the liner 20. The preferable power source is a rechargeable battery strip 32 located at the base of the liner 20, and which is recharged by any suitable conventional means.

As shown in FIGS. 3 and 4 of the drawings, a combination power switch and dimmer control 22 is secured to the liner 20 and is electrically connected between the light source 26 and the power source 32 to vary the electrical power supplied to the light source 26.

Figure 2:
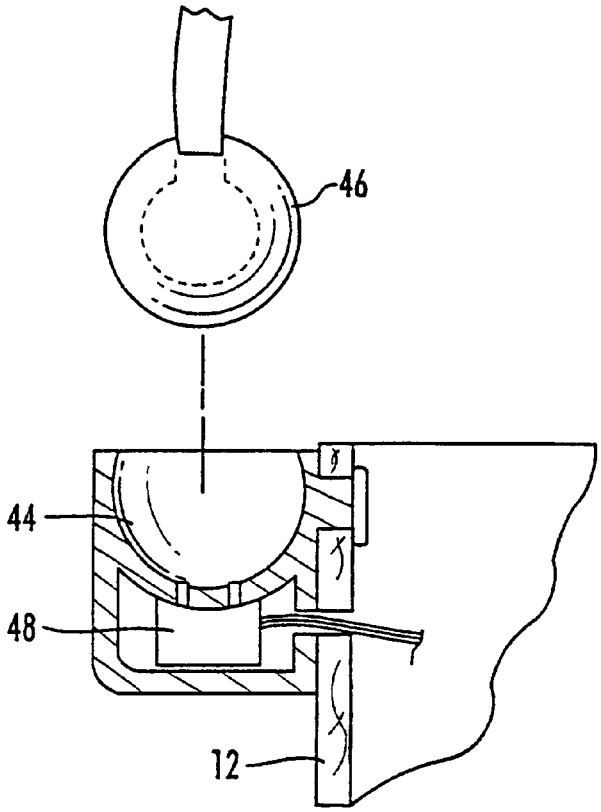
FIG. 2 is a schematic sectional view taken along line 2—2 of FIG. 1.
Figure 5:
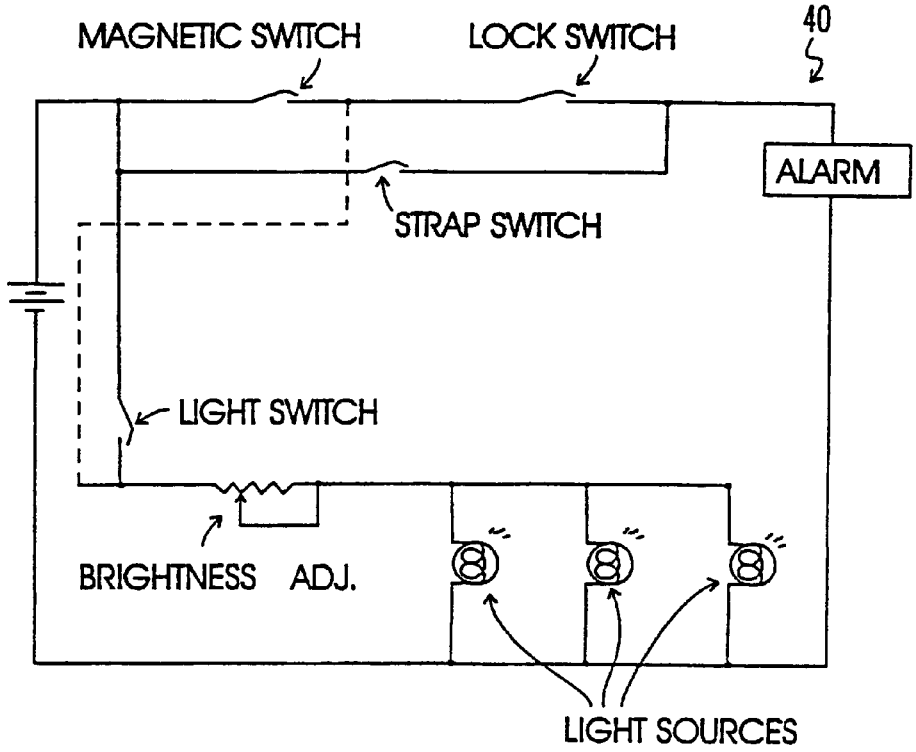
FIG. 5 is a schematic diagram of the preferred circuitry of the present invention.

As shown in FIGS. 2 and 5, an alarm system 40 is secured within the handbag retainer device 12 for detecting when a strap 14 secured to the handbag retainer device 12 is disconnected from the handbag (such as by another individual during a theft). The alarm system 40 includes a pair of strap end receiving sockets 44 located at the longitudinal ends of the receiver device 12, and each socket 44 receives a spherical ball 46 secured to each of the opposite ends of the strap 14. Each spherical ball 46 is held in a strap end receiving socket 44 by an interference-type fit such that only a strong pull on the strap 14 (such as by a thief forcibly removing the handbag receiver device from the wearer of the handbag) is able to remove the ball 46 from the socket 44. An electrical buzzer 42 is secured on the retainer device 12 and is electrically connected to the alarm system 40 such that the buzzer 42 emits an audible alarm automatically when the continuity of the circuit of the alarm system 40 is completed (by removing the ball 46 from the socket 44) at either of the strap switches 48 located within the strap end receiving sockets 44.

A magnetic lock is preferably secured on the retainer device 12 adjacent to the opening 18 for closing the retainer device 12. The magnetic lock has a first part 50 and a second part 52 which are magnetically linked. The parts 50, 52 are electrically connected to the alarm system 40 for activating the alarm system 40 and emitting an audible alarm when the retainer device 12 is opened without first deactivating the alarm system.

The power source 34 for the alarm system 40 is preferably carried in the retainer device 12. The preferred power source 34 is a rechargeable battery strip located at (and most preferably united to) the bottom of the interior compartment of the retainer device 12. In the most preferred embodiment of the invention, a recharging base 70 with contact posts 72 that are adapted to contact structures on the retainer device 12 which are in electrical communication with the positive and negative poles of the battery strip 34 in the retainer device 12 for recharging the battery when the device is placed on the recharging base 72.

Figure 6:
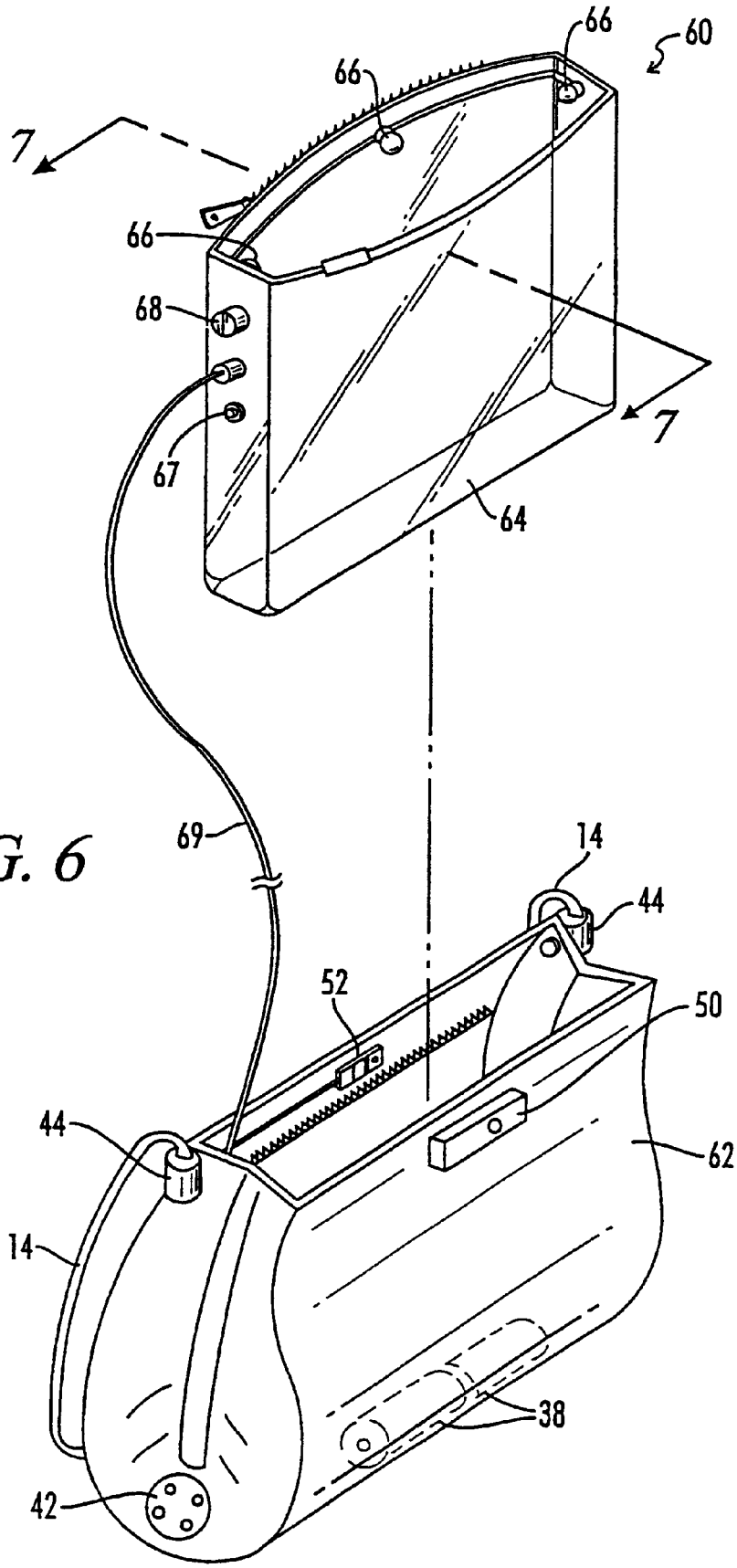
FIG. 6 is a schematic exploded upper perspective view of an alternative embodiment of the present invention.
Figure 7:
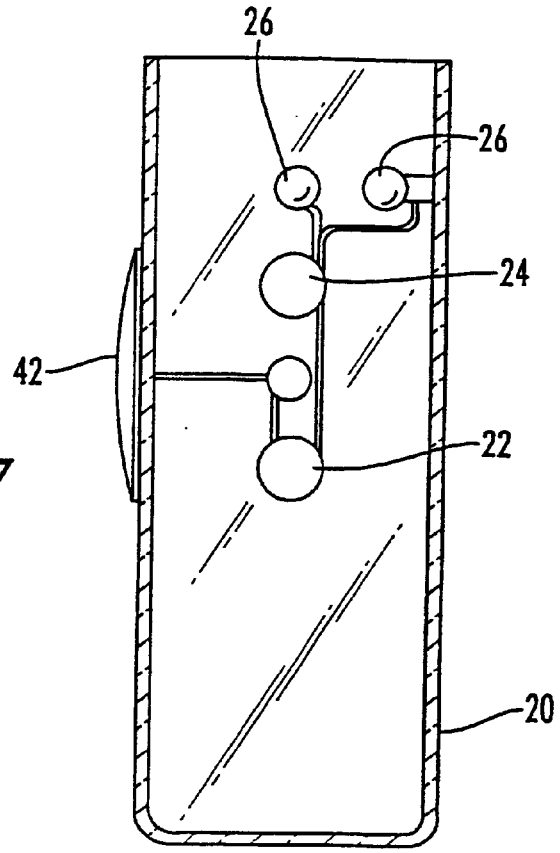
FIG. 7 is a schematic sectional view taken along line 7—7 of FIG. 6 of the alternative embodiment.
Figure 8:
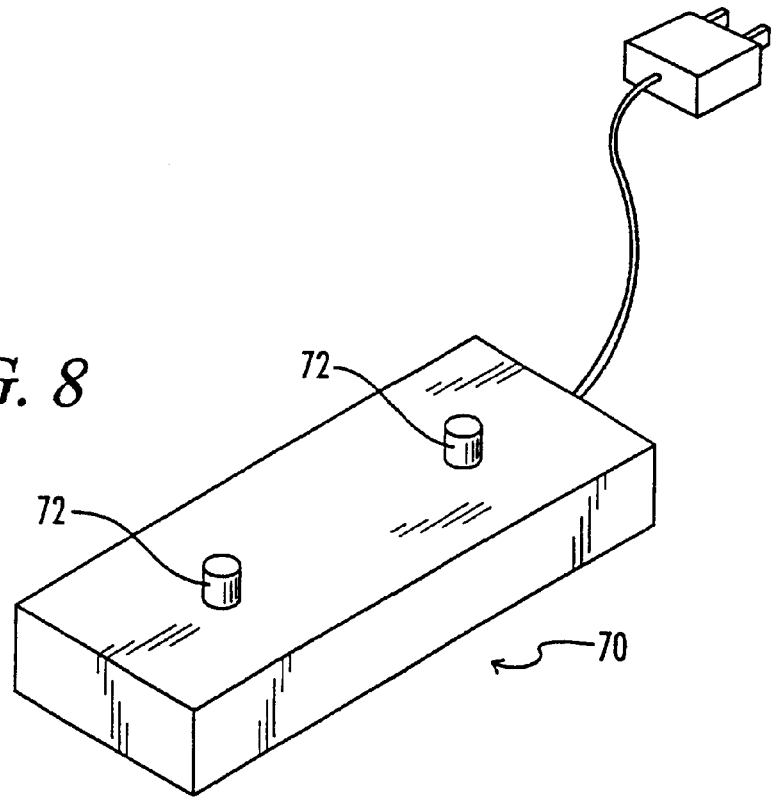
FIG. 8 is a schematic perspective view of a charging base for the retainer device of the present invention.
Figure 9:
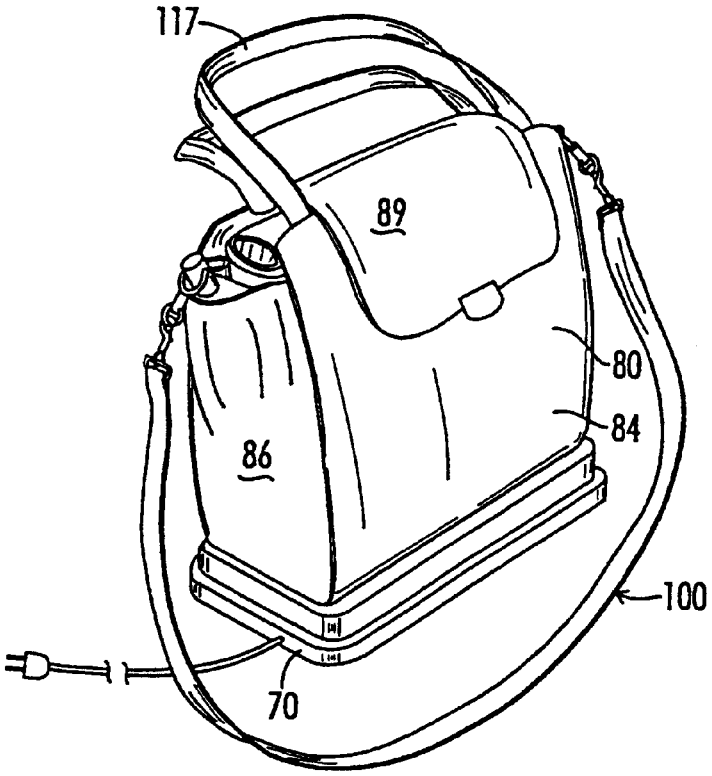
FIG. 9 is a schematic front perspective view of an optional adaptable electric accessory system for containers, receptacles, and the like according to the present invention.

An optional embodiment 60 of the present invention is illustrated in FIGS. 6 and 7 of the drawings. The optional embodiment 60 employs a retainer device 62 similar to the construction of retainer device 12 shown in FIG. 3. A liner 64 is adapted to be removably positioned within the retainer device 62, and the liner 64 is most preferably formed of a transparent sheet material which permits a user to observe through the wall of the liner 64 the objects held within the liner 64.

A light source, which preferably comprises at least one light bulb 66, is mounted on the interior of the liner 64. A dimmer switch 68 is mounted on the liner 64 to vary the power supplied to the light bulb 66. A power switch 67 provides a means of turning the light bulb 66 on and off. An electrical cord 69 transfers power from replaceable batteries 38 carried in the retainer device 62 to the liner 60.

FIGS. 9 through 16 and FIGS. 17 through 19 disclose additional embodiments of the invention showing a number of features that may optionally be incorporated as shown or with other embodiments of the invention.

The system includes a receptacle 80 having an interior compartment 81. The receptacle has an outer housing 82 constructed from a flexible material and which includes a substantially rectangular bottom panel 83, a front panel 84 and a rear panel 85, and a pair of end panels 86, 87 connecting the front and rear panels. The front panel, the rear panel, and the end panels extend upwardly from the bottom panel, the front, rear and end panels to define an open top and an interior space. A flexible flap 89 may be integrally coupled to a top portion of the rear panel of the outer housing such that the flap may be positioned to cover the open top of the outer housing. The flap of the outer housing may be releasably secured in a covering position by a snap fastener, a zipper, hook and loop fasteners, and the like.

The receptacle 80 may be provided with a frame 90 to support the panels of the receptacle and engage the insert constructed from a substantially rigid material and including a bottom wall 91, which may have a substantially planar rectangular configuration. The bottom wall has relatively shorter ends and relatively longer sides. A pair of upstanding primary side walls 92, 93 may each have a bottom end coupled to one of a pair of short ends of the bottom wall. The primary side walls 92, 93 extend upwardly from the bottom wall. A pair of upstanding secondary side walls 94, 95 are also provided. Each of the secondary side walls have a lower extent coupled to the bottom end of one of the primary side walls. Each of the secondary side walls extend outwardly and upwardly from the bottom end of the corresponding primary side wall. Each of the secondary side walls has an upper extent extending upwardly in spaced parallel relationship with one of the primary side walls.

The receptacle preferably includes a receptacle electrical assembly. See FIGS. 15 and 25. The receptacle electrical assembly may include at least two first conductive contacts 96, 97 exposed through the bottom panel 83 of the outer housing such that placement of the outer housing of the receptacle on the charging base 70 brings the first conductive contacts into contact with the second conductive contacts 74, 75 of the charging base. A power adapter connector 98 may be mounted on the top end of one of the secondary side walls of the frame for being releasably connected to a connector of a portable electronic device. See FIG. 13. The receptacle electrical assembly may further include a pair of conductive sleeves contacts 99 positioned on top ends of the primary side walls.

A handle assembly for the receptacle may comprise a flexible strap 100 having ends coupled to opposite end panels of the outer housing. A pair of forcible release assemblies 101, 102 may be provided for activating the alarm if the receptacle is forcibly taken away from the user. Each of the forcible release assemblies are connected to an opposite end of the strap 100 at the end panels of the receptacle. Each of the forcible release assemblies includes a socket connector 103 mounted to a top end of one of the end panels of the receptacle (see FIG. 21), or may be mounted to one of the secondary side walls of the frame (see FIG. 13). Each of the forcible release assemblies may include a ball connector 104 for releasably receiving the socket connector (see FIG. 13A). Each of the ball connectors has a lower extent with a substantially spherical configuration received in one of the socket connectors. The ball connector has an upper extent with a loop connected to one of the ends of the strap 100. The forcible release assembly further comprises a retainer plate 105 for closing a chamber in the socket connector receiving the ball connector. The retainer plate has an opening 106 that permits the strap connecting loop of the upper extent of the ball connector to pass through the retainer plate. The retainer plate is adapted to release the ball connector from the socket connector upon the application of a significant pulling force on the strap and the strap connecting loop of the ball connector. The forcible release assembly further comprises a pair of alarm switches 108, with each of the alarm switches being situated in the chamber of one of the socket connectors of the handle assembly for transmitting an alarm triggering signal upon the disconnection of either one of the ball connectors from the respective socket connector.

Figure 26:
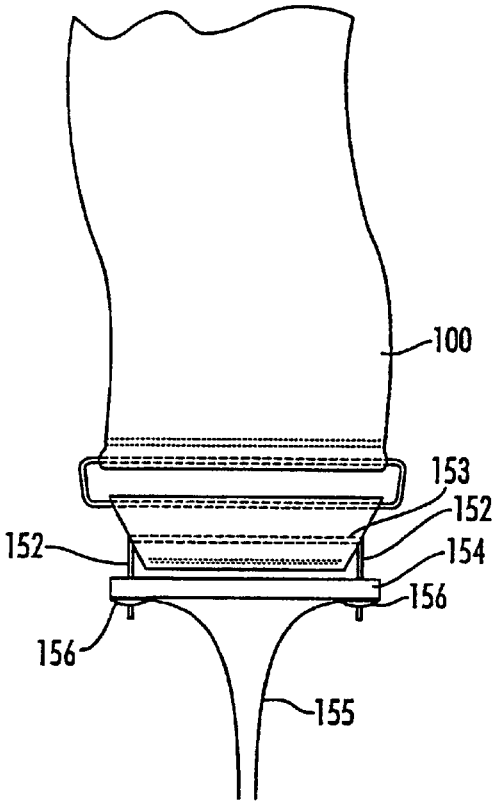
FIG. 26 is a schematic view of a portion of an optional forcible release assembly.
Figure 27:
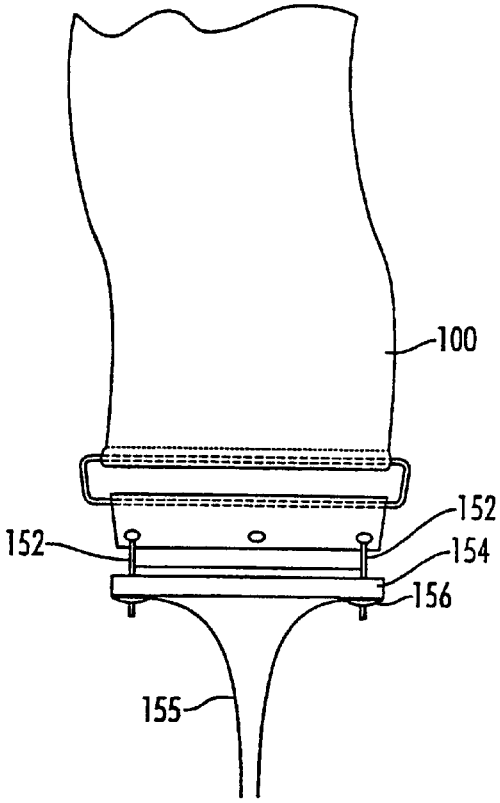
FIG. 27 is a schematic view of a portion of an optional forcible release assembly.
Figure 28:
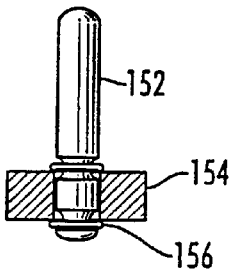
FIG. 28 is a schematic sectional view of a portion of the optional forcible release assemblies shown in FIGS. 26 and 17.

Optionally, other types of connectors or "break-away" switches may be provided in lieu of the ball and socket connectors described. For example, optional embodiments employing a number of types of insertion pin structures are illustrated in FIGS. 26 through 29. FIGS. 26 through 28 show a pair of variations on a similar structure employing a pair of pins at each forcible release assembly. The structure of FIG. 26 employs pins 152 which are connected together by a crossbar 153, and the structure of FIG. 27 utilizes individual pins. In each structure, the pins are fixed to the flexible strap 100 in a suitable manner, and each of the pins extends through a plate 154 mounted on the receptacle. Each of the pins has a first annular groove, and a ring 156 is situated in each of the first annular grooves of the pins. The rings, as well as the pins, may be electrically conductive and the rings are preferably each connected to the alarm circuitry (e.g., by wires 155) such that removal of one or both of the pins destroys the electrical continuity between the wires connected to the rings, and triggers the alarm circuitry. Optionally, the plate 154 may be formed of insulative material and the continuity provided by the pins and the pin mounting structure (e.g., the crossbar) with the continuity being broken by forcible removal of the pins from the rings, or the plate may be electrically conductive with the continuity being broken by forcible removal of the pins from the plate.

Figure 29:
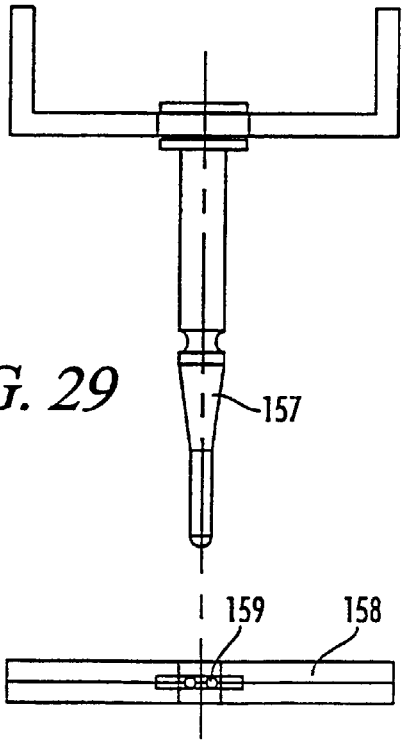
FIG. 29 is a schematic view of a portion of an optional forcible release assembly

Another variation of the forcible release assembly is shown in FIG. 29, and the structure of this variation employs a single pin 157 having an annular groove, and a base member 158 having an aperture with a pair of rods 159 extending in a substantially parallel orientation across the aperture. The rods are biased together for situating in the annular groove when the pin is inserted into the aperture, and the biasing of the rods requires that substantial force be applied to the pin to remove it from the aperture to trigger an alarm. The alarm circuitry may be triggered by removal of the pin from the aperture, and the triggering signal may be generated by any suitable means. This variation of the forcible release assembly may be preferable in that the withdrawal of the pin from the aperture does not require destruction of the rods, and therefore the pin may be reinserted into the aperture for subsequent reuse of the receptacle with the forcible release assembly intact.

Preferably, the system further includes an insert 110 for being removably positioned in the interior compartment of the receptacle. The insert has an insert casing 111 formed from a flexible material. The insert casing includes a bottom wall panel 112, a front wall panel 113, a rear wall panel 114, and a pair of end wall panels 115,116. The front, rear, and end wall panels extend upwardly from the bottom wall panel for defining an open top and an interior of the insert. The insert casing may optionally include a flexible insert strap 117, and may optionally include a flexible insert flap 118 for positioning over the open top of the insert casing. The front wall panel and the rear wall panel may comprise a transparent material. Optionally, any of the various faces of the purse insert may be opaque, translucent, or transparent. Opaque materials that may be used include leather, vinyl, and the like. The insert casing may also have a bottom compartment 121 for a purpose described below.

Figure 10:
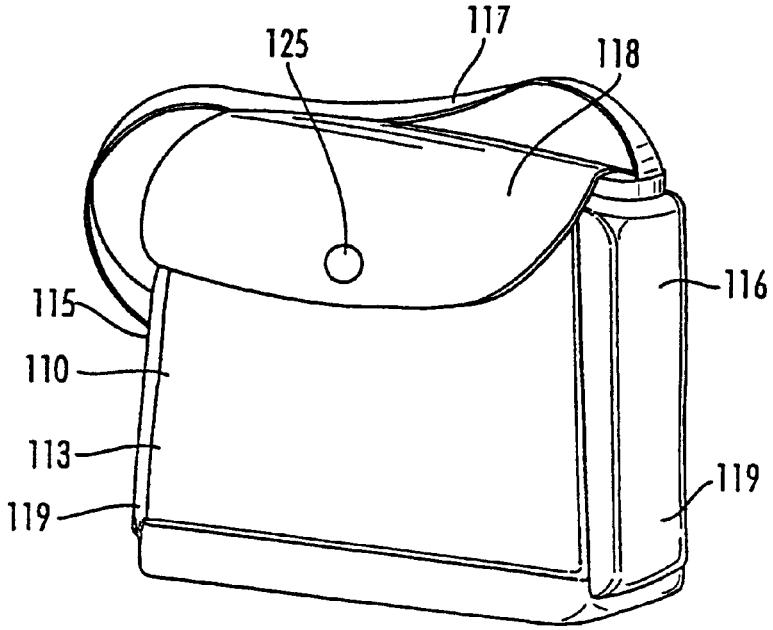
FIG. 10 is a schematic front perspective view of the insert of the present invention removed from the receptacle.
Figure 11:
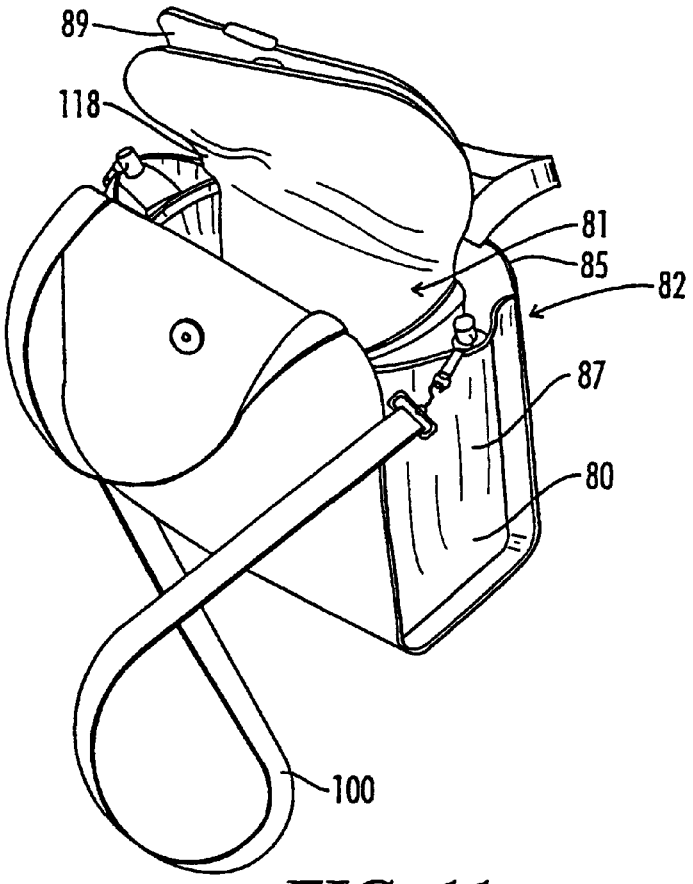
FIG. 11 is a schematic perspective view of the present invention with the flaps of the insert and the receptacle in an open orientation.
Figure 12:
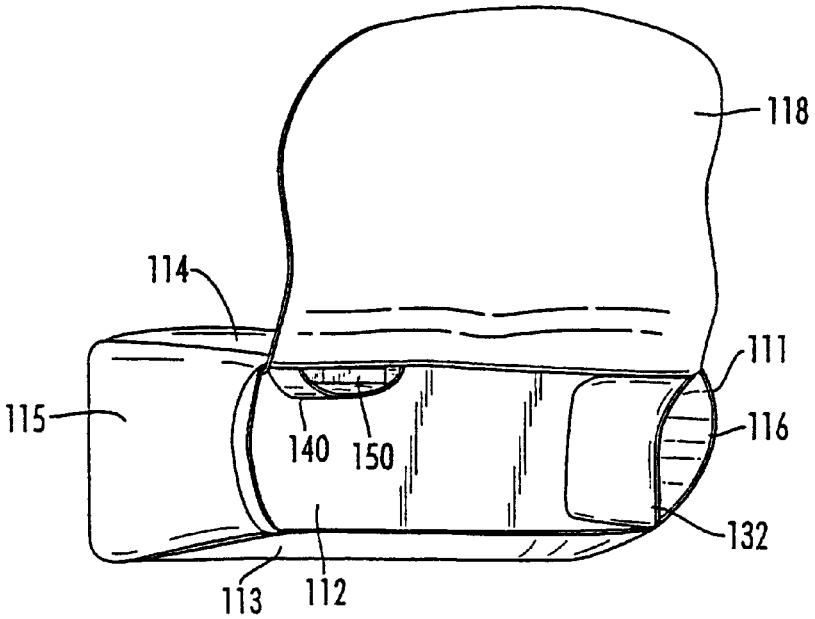
FIG. 12 is a schematic top view of the insert showing the fiber optic liner panels thereof.

As shown in FIG. 10, the end wall panels of the insert casing may optionally each include a pair of sleeves 119 with open bottom ends for use with the optional frame of the invention. Such sleeves each preferably encompass the entire associated end wall panel. In use, the insert is inserted into the interior compartment of the receptacle. In this orientation, the sleeves of the insert casing removably receive the primary side walls of the frame of the receptacle while the secondary side walls remain between the end wall panels of the insert casing and the end panels of the receptacle. See FIG. 13.

Figure 13:
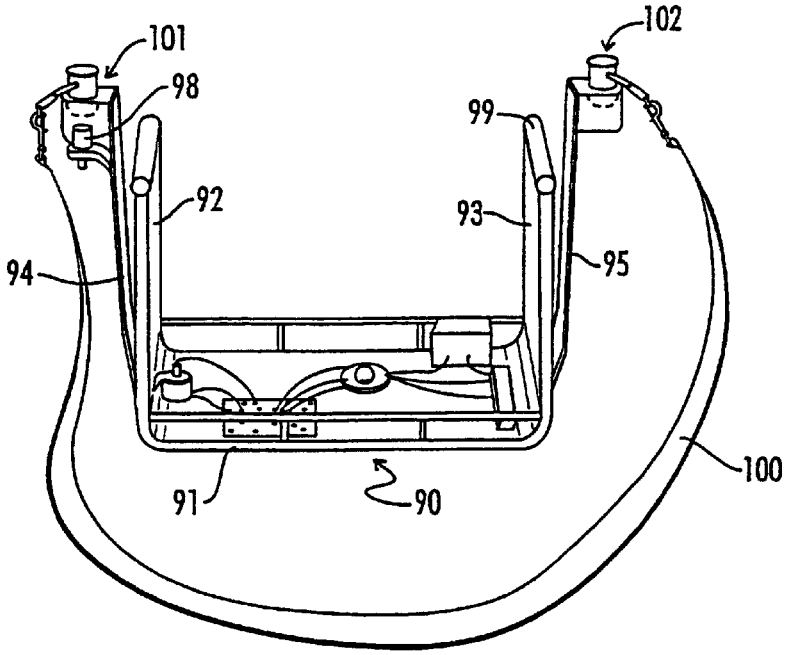
FIG. 13 is a schematic front view of the frame of the receptacle of the present invention.
Figure 13A:
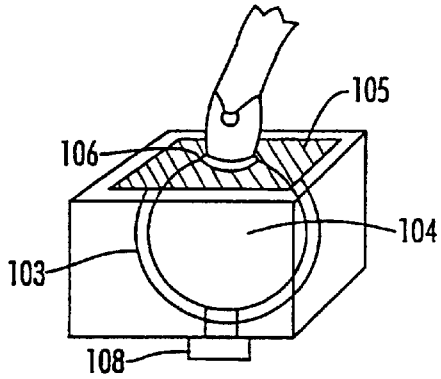
FIG. 13A is a schematic side view of a portion of an optional forcible release assembly of the present invention.
Figure 14:
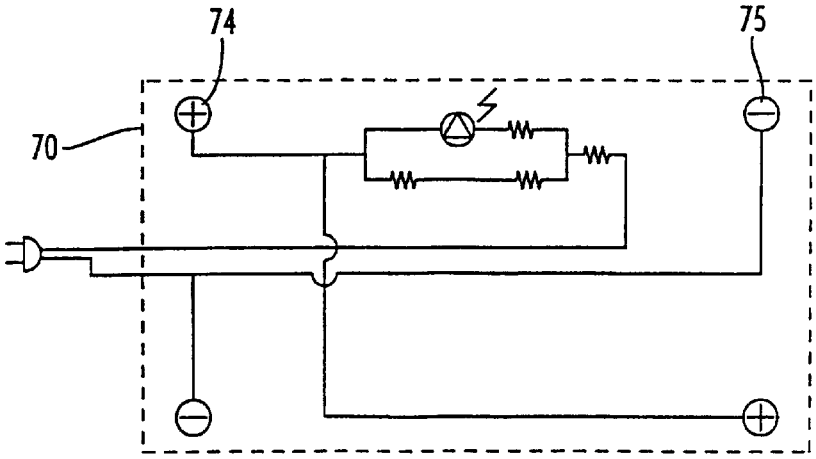
FIG. 14 is a schematic diagram of the electrical interrelationships of the electrical components of one embodiment of the charging base of the present invention.
Figure 15:
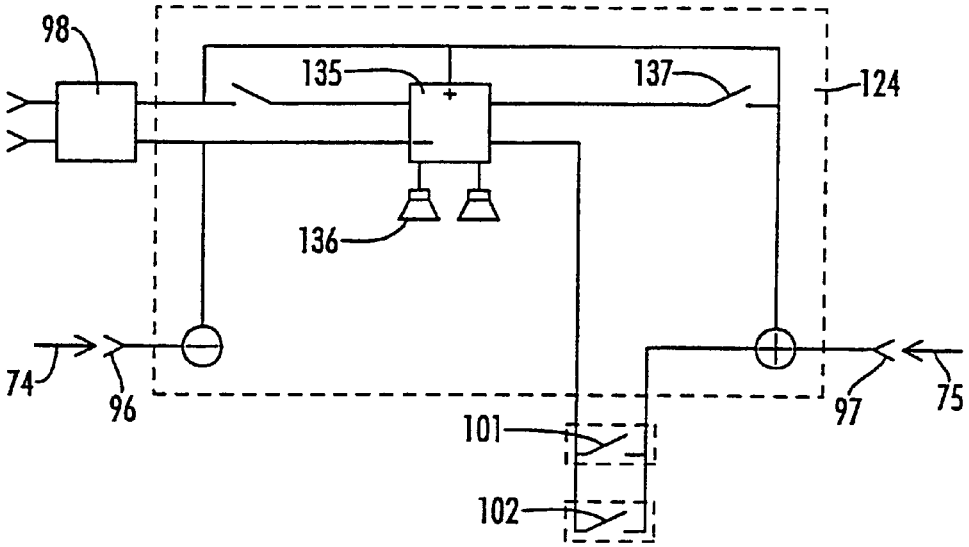
FIG. 15 is a schematic diagram of the electrical assembly of the receptacle of the present invention.
Figure 16:
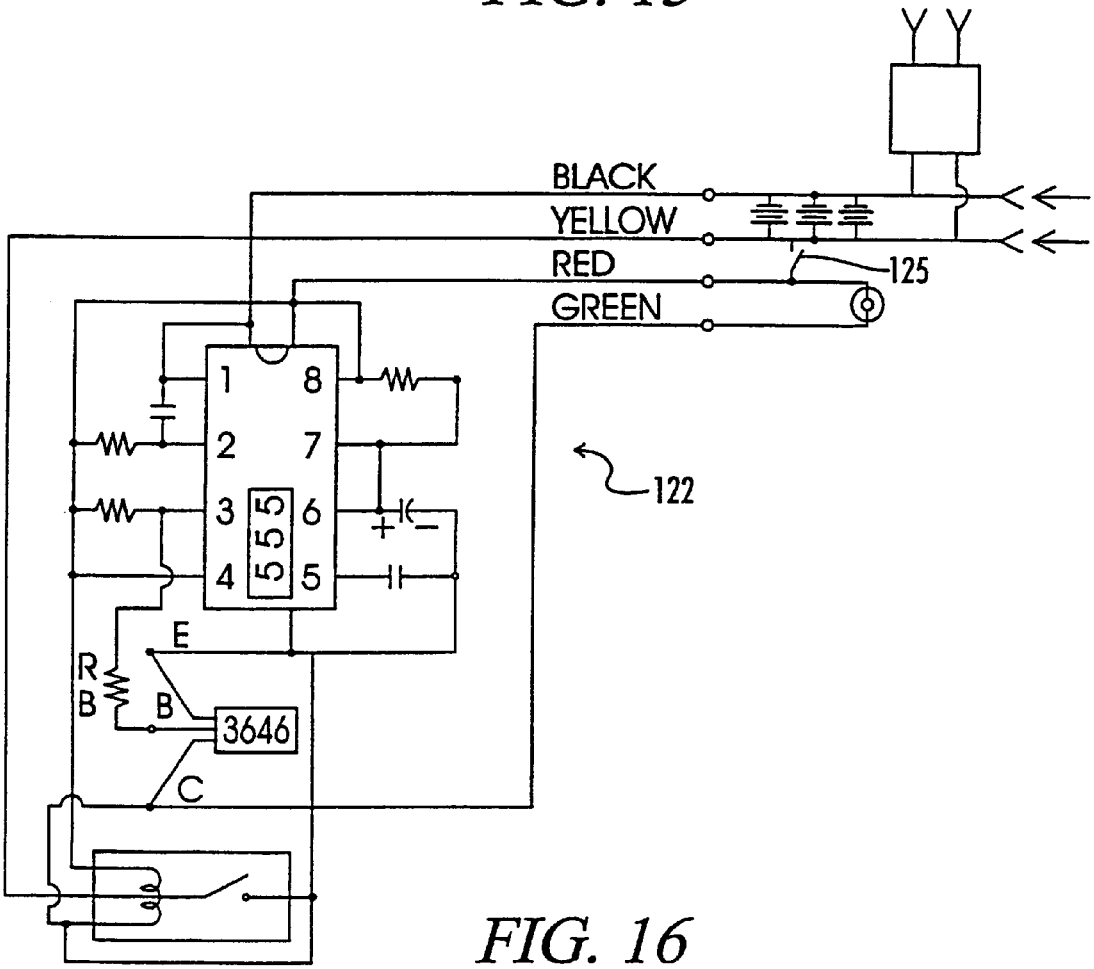
FIG. 16 is a schematic diagram of a timer mechanism of the insert of the present invention.
Figure 17:
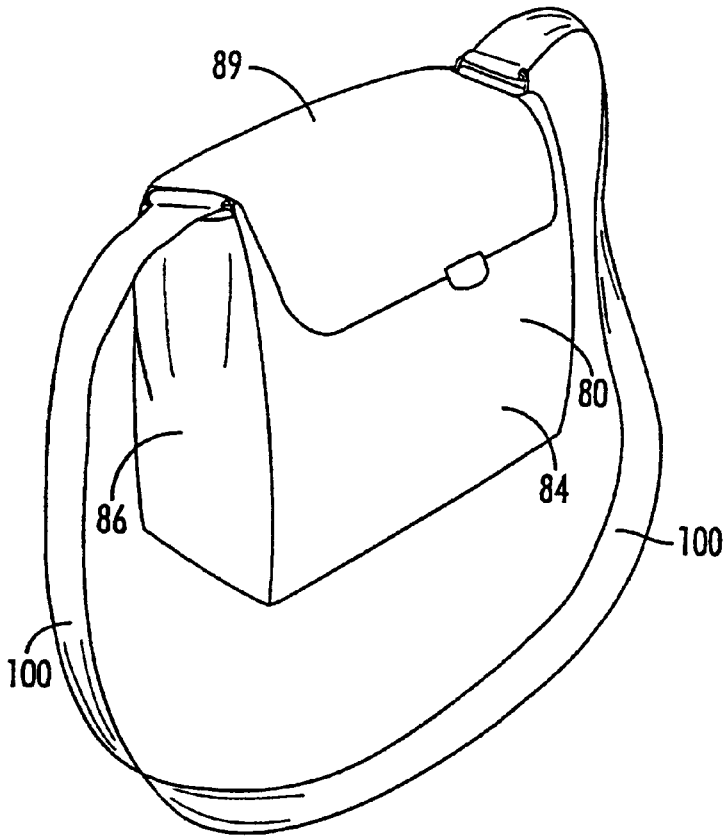
FIG. 17 is a schematic perspective view of the exterior of another optional embodiment of the present invention.
Figure 18:
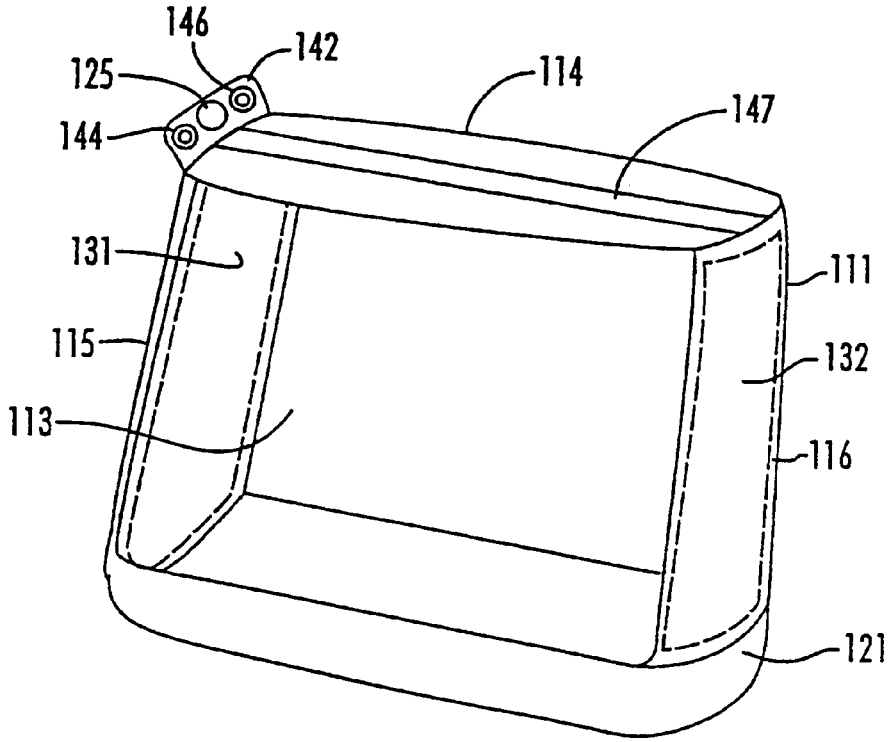
FIG. 18 is a schematic perspective view of the insert portion of the optional embodiment of FIG. 9.
Figure 19:
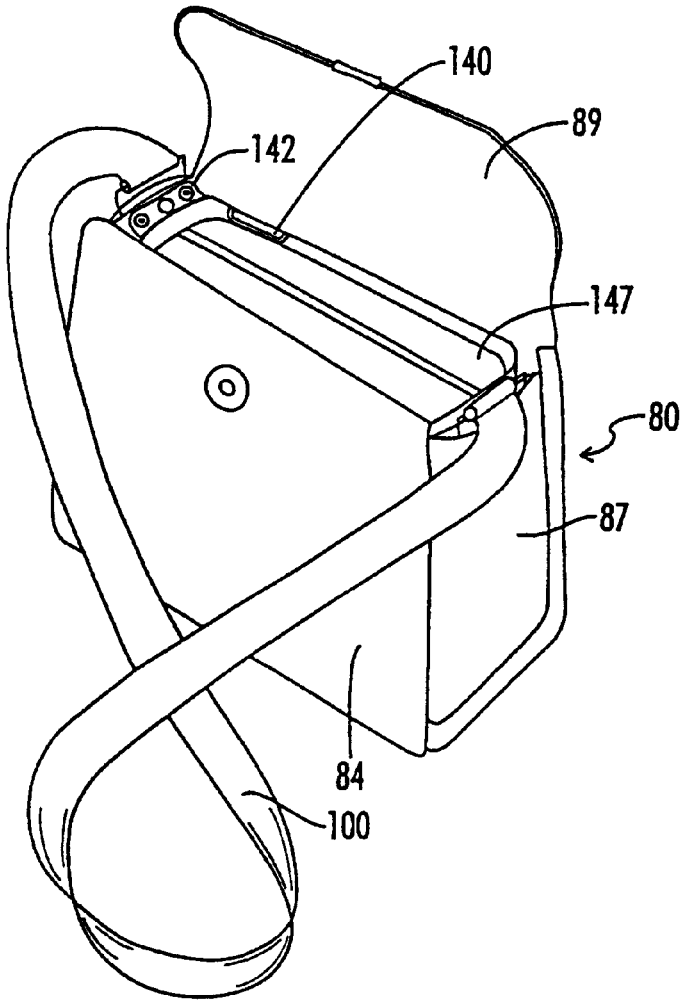
FIG. 19 is a schematic perspective view of the optional embodiment of FIG. 9 with the lid raised to particularly illustrate the insert located in the receptacle of the present invention.
Figure 20:
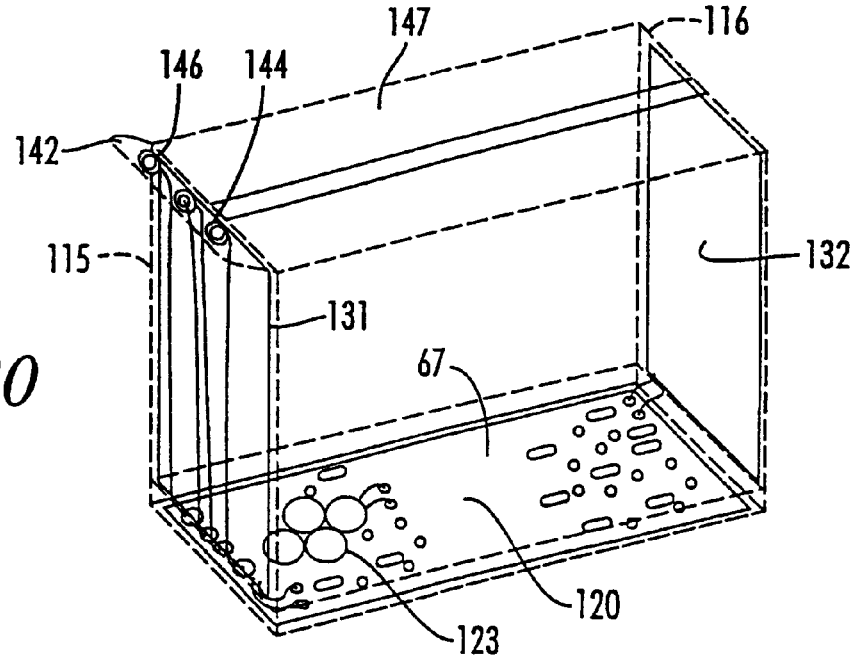
FIG. 20 is a schematic perspective phantom view of the insert of the present invention particularly illustrating circuitry of the insert.
Figure 21:
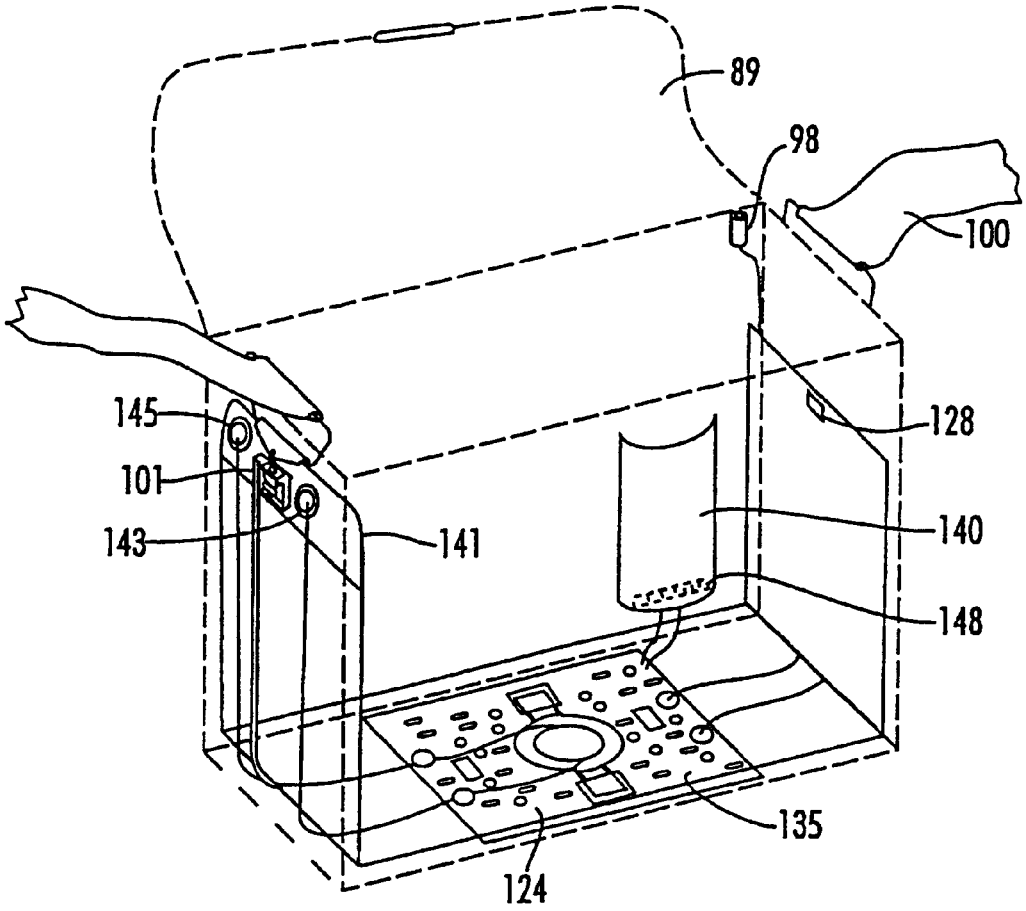
FIG. 21 is a schematic perspective phantom view of the receptacle of the present invention particularly illustrating circuitry and internal walls of the receptacle.
Figure 22:
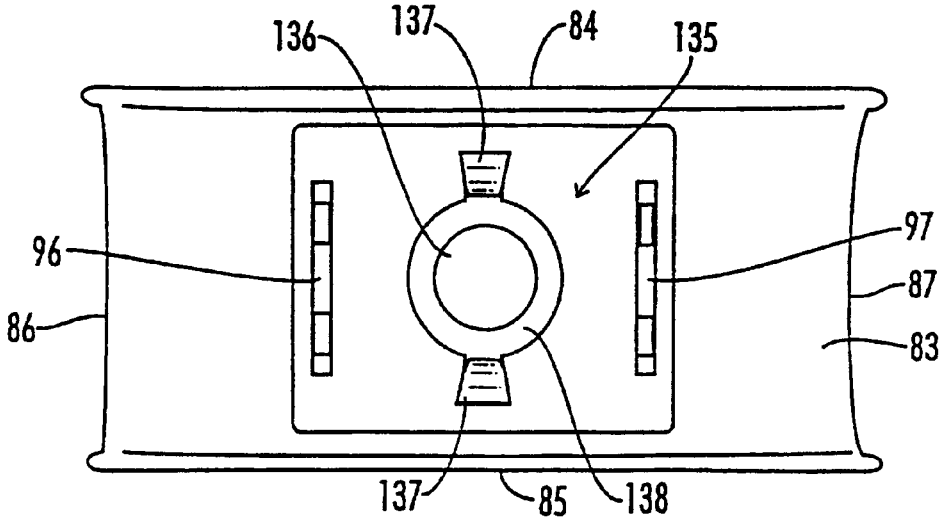
FIG. 22 is a schematic bottom view of the receptacle of the invention particularly illustrating the features of the bottom of the receptacle.
Figure 23:
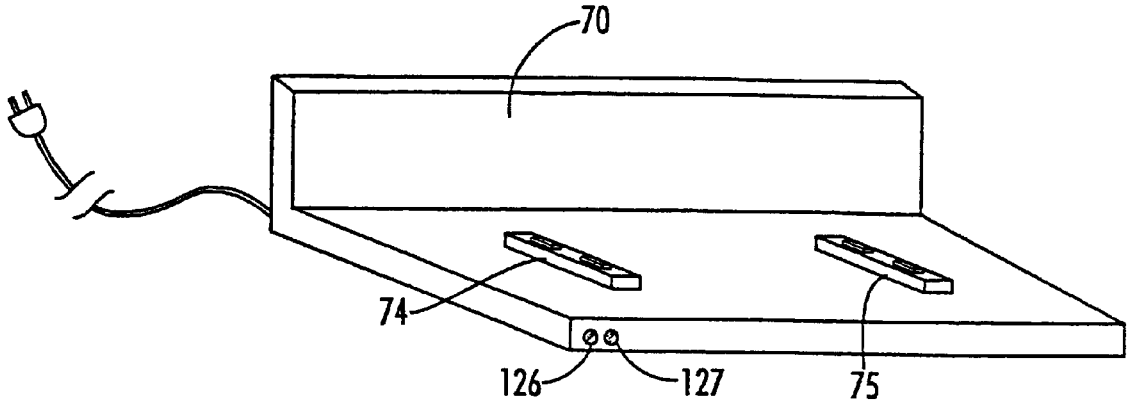
FIG. 23 is a schematic perspective view of an optional embodiment of a charging base of the present invention.
Figure 24:
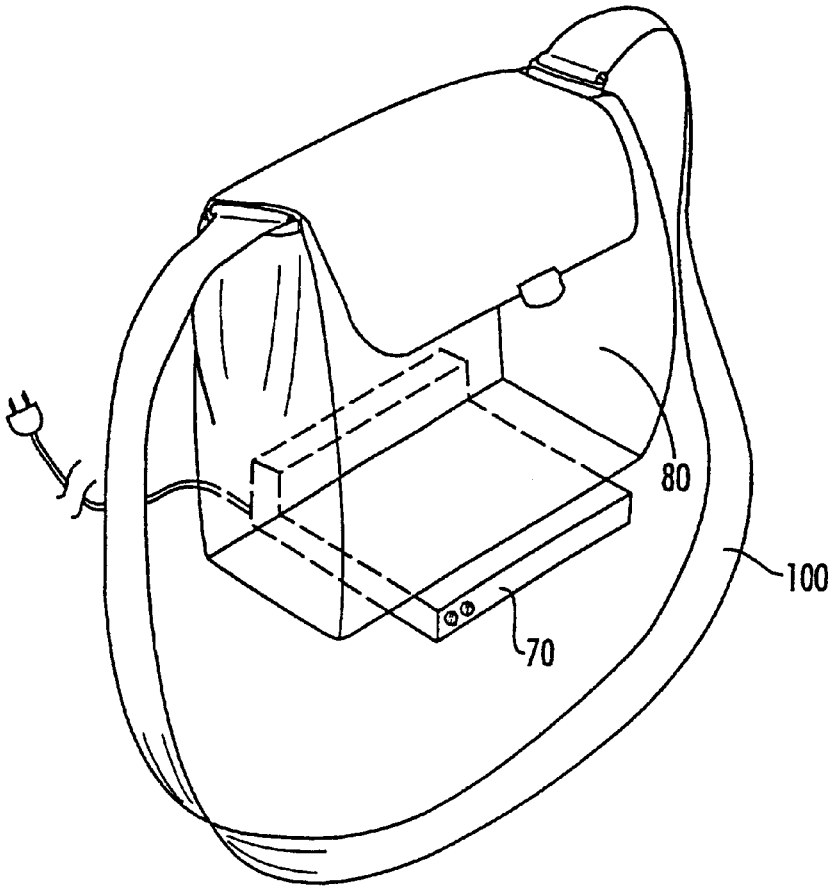
FIG. 24 is a schematic perspective view of the receptacle rested on the charging base for charging the battery.
Figure 25:
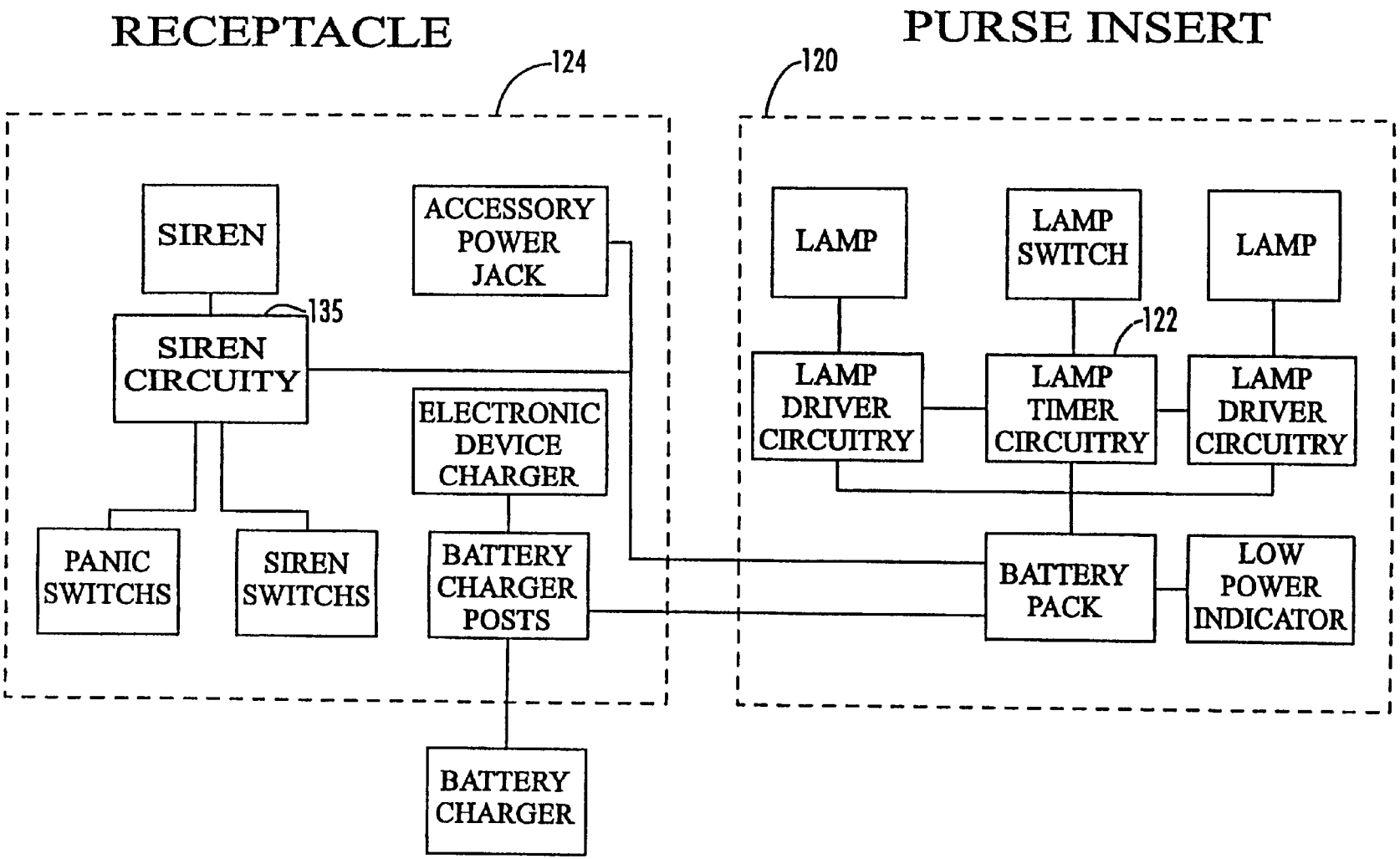
FIG. 25 is a schematic diagram of the electrical interrelationships of the components of the receptacle and the insert of the optional embodiment.

An insert electrical assembly may also be provided for the insert, and mounted on the insert. The insert electrical assembly 120 is preferably mounted in the bottom compartment 121 of the insert casing. The insert electrical assembly includes a timer mechanism 122 for generating an actuation signal for a predetermined amount of time upon the actuation thereof (See FIG. 25). A button maybe situated on the insert, and is connected to the timer mechanism for actuating the timer mechanism upon the depression of the button. A power source 123 is mounted on the insert for supplying power to the illumination source of the insert and circuitry on the receptacle, including the alarm apparatus. The power source comprises at least one battery mounted on the insert casing. In the embodiment of FIG. 13, the battery may be connected to a pair of conductive sleeve contacts 99 on the frame of the receptacle for electrically connecting the insert electrical assembly with the receptacle electrical assembly when the insert is positioned in the receptacle. The battery may have a first mode when the receptacle is situated on the charging base during which power from the charging base is supplied to the battery through the receptacle for recharging the battery, and may also be supplied to the power adapting apparatus for recharging an electrical device located in the receptacle. The battery may also have a second mode when the receptacle is removed from the charging base, and during the second mode the battery supplies power to the receptacle electrical assembly 124 (e.g., the alarm apparatus) and the insert electrical assembly 120 (e.g., the illumination apparatus), and may also supply power through the power adapter connector to an electric device 150.

Significantly, an illumination apparatus is mounted on the insert for illuminating the insert. The illumination apparatus comprises a light source, and in some embodiments, a light diffusion structure. The light diffusion structure includes at least one illuminating liner panel 131,132 in communication with the light source. The liner panel or panels preferably line an interior surface of the end wall panels of the insert casing. Optionally, the liner panel may comprise a light diffusion structure including a plurality of fiber optic strands. The fiber optic strands are preferably interwoven into a matrix of fiber optic strands to define a fabric structure. The ends of the fiber optic strands may be bundled together by a clamp. The light source is positioned adjacent to the ends of the fiber optic strands of the fiber optic liner panels for illuminating the strands.

It should be understood that various other fiber optic liners may be employed in lieu of the one set forth hereinabove per the desires of the user. An example of a fiber optic material is available through Lumitex Corp. Further, as an option, other types of illumination apparatus may be employed such as one employing a chemilluminescent light, and the like. Even more preferably, the liner panels may comprise panels of electroluminescent material, which provide both the light source and the light diffusion structure.

A timer mechanism 122 may be provided on the insert for causing illumination of the illumination apparatus for a predetermined period of time upon the closing of a switch. The illumination apparatus is connected to the timer mechanism, and the illumination apparatus is supplied with power for a period of time by the timer mechanism after the timer mechanism is activated. The timer mechanism may be adapted for illuminating the illumination apparatus for a predetermined a mount of time (such as, for example, a period of 15–30 seconds) after the activation of the timer mechanism. See FIG. 16.

An optional charging apparatus may be provided for providing power to the power source, or battery, for recharging the battery. See FIG. 23. The charging apparatus may provide power for recharging the battery of the liner (or the receptacle) through the receptacle. The receptacle is removably mountable on the charging apparatus. The charging apparatus comprises a charging base 70 with at least two second conductive contacts 74, 75 mounted on the charging base for electrically contacting the first conducting contacts of the receptacle. The second conductive contacts may be mounted on a top face of the charging base. Optionally, a charging light 126 may be mounted on the charging base, with the charging light being connected between the conductive contacts and a primary power source. The charging light is adapted to illuminate upon the flow of current through the conductive contacts. A full charge light 127 may be mounted on the charging base for illuminating when a full charge condition of the battery is detected.

While a physical electrical contact has been disclosed hereinabove to carry out the recharging of the battery using the charging base, it should be understood that other types of electrical communication may be relied upon for recharging. For example, a coil and post combination may be provided for affording inductive electric communication. As an option, a cigarette lighter cord and plug may be connected to the adapter connector of the power adapter apparatus such that the battery may be recharged in a vehicle as opposed to using the charging apparatus.

The system of the invention may also include an alarm apparatus for providing an audible alarm upon triggering of the alarm apparatus 135. The alarm apparatus is mounted on the receptacle. The alarm apparatus is electrically connected to the power source or battery of the insert or a battery contained in the receptacle, especially if no insert is employed. The alarm apparatus may include a siren 136 for producing a loud sound when the alarm apparatus is triggered. The siren is mounted on the receptacle, preferably on the bottom panel of the receptacle. The alarm apparatus may be triggered in at least two ways. The alarm apparatus may be triggered upon the removal of a strap attached to one of the forcible release assemblies 101, 102 of the receptacle. An alarm activating switch 137 may be mounted on the bottom panel of the receptacle, and the alarm activating switch may be adapted to trigger the alarm apparatus when the alarm activating switch is actuated. Optionally, the siren may be centrally located in a depression 138 or recess in the bottom panel of the receptacle, and one or more alarm activating switches may be positioned in or closely adjacent to the perimeter of the depression or recess.

A pocket 140 may be provided for removably receiving an electrical device that is desired to be carried by the user. Preferably, the pocket is located in the interior compartment of the receptacle, and is formed on one of the panels of the receptacle (See FIG. 19). As an option, the pocket may be formed on the insert (See FIG. 12) to removably receive the various aforementioned electronic devices.

Significantly, a power adapting apparatus may be provided for supplying power to an electrical device carried in the receptacle, such as in the pocket if the receptacle is so provided. The power adapting apparatus is mounted on the receptacle, and is connected to the power source or battery mounted on the liner. An adapter connector 98 is situated on the receptacle, and may be situated in the pocket for engaging an electrical device positioned in the pocket. In one embodiment, the adapter connector 148 is adapted to releasably connect to the electronic device by simply sliding the electronic device in the pocket (See FIG. 21). This may be accomplished with strip contacts and the like. Ideally, the universal recharging adapter is capable of connecting with any one of a plurality of electronic devices.

The adapter connector may optionally be provided in another location on the receptacle, and may even be located on the exterior of the receptacle. For example, a plug-in power adapter may be mounted to the top end of one of the secondary side walls (See FIG. 13) for being releasably connected in electric communication with a portable electronic device 150. The portable electronic device may comprise a portable telephone, a paging device, a calculator, a portable computing device, a video game, or any other type of electrically powered device that may use electrical power supplied by the battery of the insert, or includes its own rechargeable battery that may be recharged simultaneously with the battery of the electric system for the receptacle when the receptacle is placed on the charging base 70.

A charge status indicating light 128 may be provided on the receptacle or the insert for illuminating when a low charge condition is detected in the battery or batteries of the insert or receptacle.

For transferring power from the receptacle to the battery of the insert when the battery is being charged, and from the insert to the receptacle for powering the alarm system, one optional embodiment of the invention includes a connector surface 141 on the outer housing of the receptacle, and a tab 142 extending from the insert casing of the insert. The tab of the insert is adapted to be positionable substantially adjacent and parallel to the connector surface 141 of the receptacle when the insert is positioned in the interior of the receptacle. See FIG. 19. The connector surface 141 has a first portion 143 of a first connector mounted thereon, and the second tab has a second portion 144 of a first connector mounted thereon, and the portions of the first connector are removably connectable together. The first and second portions of the first connector are electrically conductive to permit electricity to flow between the first and second portions of the first connector when the portions are physically connected. The first and second portions of the first connector may comprise first and second halves of a snap connector. The connector surface 141 also has a first portion 145 of a second connector mounted thereon, and the second tab has a second portion 146 of a second connector mounted thereon, and the portions of the second connector are removably connectable together. The first and second portions of the second connector are electrically conductive to permit electricity to flow between the first and second portions of the second connector when the portions are physically connected. The first portion of the first connector and the first portion of the second connector are each in electrical communication with the receptacle electrical assembly (e.g., the alarm assembly). The second portion of the first connector and the second portion of the second connector are in electrical communication with the insert electrical assembly (e.g., the battery and the illumination assembly).

A switch 125 (such as, for example, a push button) may optionally be mounted on the second tab of the insert casing for activating the timer mechanism for illuminating the illumination apparatus for a period of time.

Optionally, the insert casing may be provided with a top wall panel 147 that closes the open top. The top wall panel has a closable slit that extends substantially parallel to the front and rear wall panels. See FIGS. 18 and 20.

In further detail, one embodiment of the timer mechanism (See FIG. 16) preferably includes a 555 timer with an output connected to an NPN transistor which drives a relay. Such relay is connected to the light source for supplying sufficient voltage to the light source. Ideally, each of the components of the electrical assemblies of both the purse insert and carriage are miniaturized and of a minimal weight. Further, as an option, a dimmer may be included for controlling an intensity in which the lamp and fiber optic liner are illuminated. Such dimmer may take the form of a potentiometer used in place of one of the resistors shown in FIG. 16.

In various alternate embodiments, the concepts of the receptacle and insert may be employed in the arts of luggage, plastic bags, waterproof scuba bags, military & camping backpacks, general purpose back packs, emergency medical equipment containers, emergency fire fighting equipment containers, police equipment containers, NASA-shuttle and space station tool and equipment bags which contain emergency items, underground utility and mining pouches, plumber tool bags, or virtually any other receptacle. It should be further noted that the various components of the present invention may be compiled into a single receptacle for affording a simpler design.

It will be realized that a possible embodiment of the invention would have the insert of the invention omitted from the structure, and the various features of the insert incorporated on or into the receptacle. It is noted that an embodiment of the invention lacking the removable insert would thus lack the quick and easy movement of the features (e.g., the illumination apparatus) of the insert between different receptacles, including any contacts of the insert. The insert permits this quick and easy interchange of the illumination apparatus, the battery (if included on the liner), and any contacts of the liner between a variety of receptacles. Nonetheless, some or all of the features of the insert may easily be incorporated into the receptacle or container.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An illuminating accessory system comprising:

a retainer device defining an interior compartment;

a liner having an interior adapted for removably receiving objects to be carried by said retainer device through an opening in said liner, said liner being removably positioned within the interior compartment of said retainer device, said liner having an exterior substantially coextensive with said interior compartment of said retainer device when said liner is positioned in said retainer device;

at least one light source secured on said liner for illuminating the interior of said liner and any objects positioned in said liner, and an electrical power source secured on said liner in a manner such that said electrical power source is removable with said liner from said retainer device;

wherein said liner, said at least one light source, said electrical power source, and any objects received in the interior of said liner are removable as a unit from said retainer device for permitting insertion of said unit into another said retaining device.

2. The illuminating accessory system of claim 1 wherein said liner is formed of a light emitting fabric for illuminating substantially the entire interior of said liner.

3. The illuminating accessory system of claim 1 additionally comprising a combination power and dimmer switch secured to said liner for providing infinite variance of the electrical power provided by said power source to said light source.

4. The illuminating accessory system of claim 1 additionally comprising a shoulder strap mounted to said retainer device and an alarm system secured on said retainer device for detecting when said shoulder strap is removed from its mounted condition on said retainer device.

5. The illuminating accessory system of claim 1, wherein said retainer device has an interior surface defining the interior compartment of said retainer device, said liner having an exterior surface of a shape and size generally conforming to a size and shape of the interior surface of said interior compartment of said retainer device such that the exterior surface of said liner is located adjacent to the interior surface of said retainer device when said liner is removably positioned in said retainer device, said liner comprising a plurality of wall panels.

6. The illuminating accessory system of claim 1 additionally comprising a magnetic lock secured to said retainer device for closing the opening of said retainer device, wherein said magnetic lock is electrically connected to said alarm system for activating said alarm system upon opening of said retainer device when said alarm system is activated.

7. The illuminating accessory system of claim 1 wherein said liner is formed from a substantially transparent material to permit viewing through said transparent liner of objects held the interior of in said liner.

8. The illuminating accessory system of claim 2 wherein said light emitting fabric is comprised of a plurality of fiber optic filaments woven together and wherein said fiber optic filaments are optically connected to said light source.

9. An illuminating accessory system comprising:

a retainer device having an interior surface defining an interior compartment;

a liner having an interior adapted for removably receiving objects to be carried by said retainer device through an opening in said liner, said liner being removably positioned within the interior compartment of said retainer device, said liner having an exterior surface of a shape and size generally conforming to a size and shape of the interior surface of said interior compartment of said retainer device such that the exterior surface of said liner is located adjacent to the interior surface of said retainer device when said liner is removably positioned in said retainer device;

at least one light source secured on said liner for illuminating the interior of said liner;

an electrical power source secured on said liner in a manner such that said electrical power source is removable with said liner from said retainer device.

10. The illuminating accessory system of claim 9 wherein said liner is formed of a light emitting fabric for illuminating substantially the entire interior of said liner.

11. The illuminating accessory system of claim 9 additionally comprising a shoulder strap mounted to said retainer device and an alarm system secured on said retainer device for detecting when said shoulder strap is removed from its mounted condition on said retainer device.

12. The illuminating accessory system of claim 9, wherein said liner, said at least one light source, said electrical power source, and any objects received in the interior of said liner are removable as a unit from said retainer device for permitting insertion of said unit into another said retaining device.

13. The illuminating accessory system of claim 9 wherein said liner is formed from a substantially transparent material to permit viewing through said transparent liner of objects held in the interior of said liner.

14. The illuminating accessory system of claim 10 wherein said light emitting fabric is comprised of a plurality of fiber optic filaments woven together and wherein said fiber optic filaments are optically connected to said light source.

15. A illuminating accessory system comprising:

a retainer device having an interior compartment;

a liner having an interior adapted for removably receiving objects to be carried by said retainer device through an opening in said liner, said liner being removably positioned within the interior compartment of said retainer device, said liner comprising a plurality of wall panels defining said interior;

a pair of light sources secured on said liner for illuminating the interior of said liner and any objects in said liner, each of said light sources being mounted on one of a pair of opposing said wall panels of said liner; and an electrical power source secured on said liner in a manner such that said electrical power source is removable with said liner from said retainer device;

wherein the pair of light sources each comprise a light emitting fabric.

16. The illuminating accessory system of claim 15 wherein said retainer device has an interior surface defining the interior compartment of said retainer device, said liner having an exterior surface of a shape and size generally conforming to a size and shape of the interior surface of said interior compartment of said retainer device such that the exterior surface of said liner is located adjacent to the interior surface of said retainer device when said liner is removably positioned in said retainer device, and wherein said liner, said pair of light sources, said electrical power source, and any objects received in the interior of said liner are removable as a unit from said retainer device for permitting insertion of said unit into another said retaining device.

17. The illuminating accessory system of claim 15 additionally comprising a shoulder strap mounted to said retainer device and an alarm system secured on said retainer device for detecting when said shoulder strap is removed from its mounted condition on said retainer device.

18. The illuminating accessory system of claim 17, wherein said alarm system includes:

a pair of shoulder strap end receiving sockets each mounted on said retainer device;

a pair of spherical balls each secured to an end of said shoulder strap and being adapted to be accepted within a said receiving socket;

an electrical buzzer secured within said retainer device for emitting an audible alarm upon triggering of said alarm system;

wherein each said socket is provided with a strap switch mounted adjacent to said socket and adapted to detect removal of the spherical ball of said strap from the socket, wherein removal of said ball from said socket triggers said alarm system.

19. The illuminating accessory system of claim 15 additionally comprising a magnetic lock secured to said retainer device for closing the opening of said retainer device, wherein said magnetic lock is electrically connected to said alarm system for activating said alarm system upon opening of said retainer device when said alarm system is activated.

20. The illuminating accessory system of claim 16 wherein said liner is formed of a substantially transparent material to permit viewing through said transparent liner of objects received in the interior compartment of said liner.

21. An adaptable electric accessory system comprising:

a receptacle having an interior compartment;

an insert having an interior adapted for removably receiving objects to be carried by said receptacle through an opening in said insert, said insert being removably positioned in the interior compartment of said receptacle, said insert having an exterior substantially coextensive with said interior compartment of said receptacle when said insert is positioned in said receptacle; and a power source for supplying power being mounted on said insert for removal with said insert.

22. The adaptable electric accessory system of claim 21 additionally comprising an illumination apparatus is mounted on the insert for illuminating the insert.

23. The adaptable electric accessory system of claim 21 wherein the power source comprises at least one battery mounted on the insert.

24. The adaptable electric accessory system of claim 21 wherein the receptacle includes a frame constructed from a substantially rigid material and including a bottom wall with a substantially planar rectangular configuration, the bottom wall having relatively shorter ends and relatively longer sides, a pair of upstanding primary side walls each having a bottom end coupled to one of a pair of short ends of the bottom wall, the primary side walls extending upwardly from the bottom wall, a pair of upstanding secondary side walls each having a lower extent coupled to the bottom end of one of the primary side walls, each of the secondary side walls extending outwardly and upwardly from the bottom end of the corresponding primary side wall, and each of the secondary side walls having an upper extent extending upwardly in spaced parallel relationship with one of the primary side walls.

25. The adaptable electric accessory system of claim 21 additionally comprising a charging apparatus for providing power to the power source on the insert through the receptacle to recharge the power source, the charging apparatus comprising a charging base, the receptacle including at least two first conductive contacts and the charging base having at least two second conductive contacts for electrically contacting the first conducting contacts of the receptacle when the receptacle is rested on the charging base.

26. The adaptable electric accessory system of claim 21 wherein the receptacle includes a flexible strap having ends coupled to the receptacle, and a pair of forcible release assemblies each being connected between one of the ends of the strap and the receptacle, each of the forcible release assemblies including a pin mounted on each of the ends of the strap with each of the pins having an annular groove formed therein, and a base member mounted on the receptacle, the base member having an aperture with a pair of rods extending in a substantially parallel orientation across the aperture, the rods of each base member being biased towards each other for engaging substantially diametrically opposite sides of the annular groove when the pin is inserted into the aperture for resisting removal of the pin from the aperture and permitting reinsertion of the pin between the rods after removal.

27. The adaptable electric accessory system of claim 21 additionally comprising a timer mechanism for causing illumination of the illumination apparatus for a predetermined period of time upon the closing of an activating switch.

28. The adaptable electric accessory system of claim 22 wherein the illumination apparatus comprises at least one illuminating liner panel positioned on an interior surface of the insert such that the liner panel is removable from the receptacle as a unit with the insert.

29. The adaptable electric accessory system of claim 28 wherein the at least one illuminating liner panel comprises an electroluminescent material.

30. The adaptable electric accessory system of claim 21 additionally comprising an alarm apparatus for providing an audible alarm upon triggering of the alarm apparatus and an alarm activating switch mounted on a bottom of the receptacle, wherein the alarm apparatus is triggered upon the removal of a strap attached to the receptacle or the actuation of the alarm activating switch.

31. The adaptable electric accessory system of claim 21 additionally comprising a pocket for removably receiving an electrical device, the pocket being formed on an interior surface of the insert for permitting an electrical device received in the pocket and the insert to be removed as a unit from the receptacle.

32. The adaptable electric accessory system of claim 21 additionally comprising a power adapting apparatus for supplying power to an electrical device, the power adapting apparatus being mounted on the insert and being connected to the power source on the insert.

33. The adaptable electric accessory system of claim 21 additionally comprising a first tab formed on the receptacle, and a second tab extending from the insert and being adapted to extend substantially parallel to the first tab of the receptacle when the insert is positioned in the interior compartment of the receptacle, the first tab having a first portion of a first connector mounted thereon and the second tab having a second portion of a first connector mounted thereon, the first and second portions of the first connector being electrically conductive to permit electricity to flow between the first and second portions of the first connector, the first tab having a first portion of a second connector mounted thereon and the second tab having a second portion of a second connector mounted thereon, the first and second portions of the second connector being electrically conductive to permit electricity to flow between the first and second portions of the second connector, the first portion of the first connector and the first portion of the second connector being in electrical communication with a receptacle electrical assembly, the second portion of the first connector and the second portion of the second connector being in electrical communication with an insert electrical assembly.

34. An adaptable electric accessory system for powering an electronic device through a device connector, comprising:

a receptacle with an interior compartment for receiving the electronic device;

an illumination apparatus operably positioned on the receptacle to light the interior compartment;

a power source mounted to the receptacle and electrically connected to the illumination apparatus for providing power to the illumination apparatus, the power source including a rechargeable battery in the interior compartment of the receptacle; and a power adapter connector electrically connected to the power source and operable to electrically connect to the device connector for providing power to the electronic device.

35. The adaptable electric accessory system of claim 34, wherein the receptacle is selected from a receptacle group, the receptacle group including containers, purses, bags, luggage, backpacks, and pouches.

36. The adaptable electric accessory system of claim 34, wherein the receptacle includes a purse and the electronic device includes a portable phone such that the portable phone may be electrically connected to the power source through the power adapter connector.

37. The adaptable electric accessory system of claim 34, wherein the electronic device includes a portable computer such that the portable computer may be electrically connected to the power source through the power adapter connector.

* * * * *